United States Patent [19]

Yamamoto

[11] 4,046,470

[45] Sept. 6, 1977

[54] PRINTING PAPER CUTTING DEVICE FOR AN ELECTRICAL COPIER

[75] Inventor: Shunji Yamamoto, Shinshiro, Japan

[73] Assignee: Minolta Camera Kabushiki Kaisha, Osaka, Japan

[21] Appl. No.: 503,922

[22] Filed: Sept. 6, 1974

[30] Foreign Application Priority Data

Sept. 29, 1973 Japan ..... 48-109767

[51] Int. Cl.[2] ..... G03G 15/00

[52] U.S. Cl. ..... 355/13; 83/205

[58] Field of Search ..... 355/13, 14, 3 R; 83/203, 205

[56] References Cited

U.S. PATENT DOCUMENTS

| | | | |
|---|---|---|---|
| 3,533,691 | 10/1970 | Suzuki et al. | 355/13 |
| 3,614,220 | 10/1971 | Komori et al. | 355/13 X |
| 3,639,053 | 2/1972 | Spear | 355/13 |
| 3,651,727 | 3/1972 | Suzuki et al. | 355/13 X |
| 3,797,346 | 3/1974 | Kakii et al. | 355/13 X |
| 3,817,134 | 6/1974 | Katayama et al. | 355/13 X |
| 3,865,481 | 2/1975 | Washio et al. | 355/13 |

*Primary Examiner*—Fred L. Braun

*Attorney, Agent, or Firm*—Wenderoth, Lind & Ponack

[57] ABSTRACT

A printing paper cutting device for use in an electrophotographic copying apparatus employing a roll of printing paper which comprises a control device for cut length associated with a paper feeding and cutting device. The paper feeding and cutting device includes a pair of first rollers, a pair of second rollers, a cutting device disposed between the first and the second rollers and a pair of third rollers, and is adapted to cut the printing paper in a stretched state between the first and the second rollers with a loop of printing paper formed between the second and the third rollers, while the control device has contraction scale marks corresponding to the length of the original to be copied for compact size and easy operation of the cutting device.

6 Claims, 5 Drawing Figures

PRINTING PAPER CUTTING DEVICE FOR AN ELECTRICAL COPIER

Figure 1:
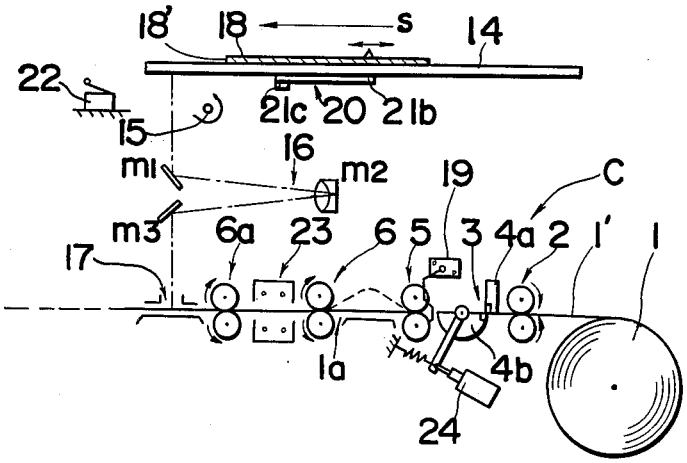

The present invention relates to an electrophotographic copying apparatus and more particularly, to a unitary printing paper cutting device for use in a copying apparatus employing a roll of printing paper.

Conventionally, there has been known a printing paper cutting device of the kind, for example, disclosed in U.S. Pat. No. 3,651,727, in which the cutter means of the cutting device is associated with control means comprising a pointer for cut length indication slidably mounted adjacent a platform for an original to be copied so that, by setting the pointer to the length of the original, the web of printing paper from a roll is cut into a length equal to the length of the original.

However, in the conventional device of the above described type, since the web of printing paper is fed in a flat state, without forming a loop, onto an exposure position through a plurality of roller pairs during the cutting process, the path in the cutting device along which the printing paper to be cut is fed tends to be long which in inevitably increases the size of the copying apparatus itself, and besides, the pointer for the cut length indication must be manually moved along the entire length of the original from one end of the original to the other end thereof to set the pointer for cutting the printing paper into the same length as the original.

Moreover, in some of the conventional cutting devices in which the web of printing paper from a roll is cut into a required length of copy paper sheet by a cutter means disposed in the path of the paper web without suspending the feeding of the web, and since the web of printing paper is cut during feeding thereof into the cutting device through a plurality of roller pairs, various defects such as slantwise or irregularly cut edges of the resultant copy paper sheet are inherent, and this is especially so, in the known copying apparatus of the type wherein copying operations such as transfer and exposure are carried out while the printing paper is being cut. There are also cases where unevenly copied images result due to fluctuations of printing paper feeding speed. In order to overcome such defects, rapid operation of the cutter means is proposed, which necessitates, however, marked improvement of the sharpness and durability of the cutting blades with consequent high cost.

In another conventional cutting device, a pair of first feeding rollers are provided before the cutter means; a pair of second feeding rollers are disposed after the cutter means; and the paper feeding speed of the former is adapted to be faster than that of the latter so as to form a loop or slacking of the printing paper web therebetween. In cutting the paper web, the cutter means is operated with the first rollers stopped. However, since the loop of the printing paper is formed in the vicinity of the cutter means, there are possibilities that portions of the printing paper other than the portion thereof to be cut will be subject to damage by contacting the cutter blades with the damaged portion, thus spoiling the copied image, or that the insufficient stretching of the paper web at the cutting position will result in curling at the cut end of the leading edge of the paper web, and this curled leading edge tends to be folded as a rotatory cutter blade of the cutter means returns to its original position, thus causing jamming of the printing paper in the cutting device.

Still another conventional cutting device proposed to overcome such disadvantages employs a large diameter roller for loop formation disposed between the cutter means and the second feeding rollers described above for forcibly forming a loop of the printing paper web. The first and second roller pairs are adapted to rotate at the same speed, and the first rollers alone are stopped when operating the cutter means in order to keep the loop around the cutter means in a stretched state without slackening.

However, the above conventional device has also disadvantages in that because of the large diameter of the loop forming roller, extra space is required along the path of the printing paper web, thus resulting in large size and complicated construction of the copying apparatus.

Accordingly, an essential object of the present invention is to provide a cutting device for printing paper fed from a roll which is easy to operate and compact in size which substantially eliminates the disadvantages inherent in the conventional cutting devices.

Another important object of the present invention is to provide a cutting device of the above described type which is accurate in functioning and simple in construction with consequent low cost.

A still further object of the present invention is to provide a cutting device of the above described type which can be applied to different types of copying apparatuses with minor alterations of the associated mechanisms.

According to a preferred embodiment of the present invention, control means for cutting the web of printing paper from a roll is associated with the operation of the cutter means disposed between a pair of first rollers and a pair of second rollers along a path of the paper web, and the scale plate for the control means is graduated with scale marks contracted by the paper feeding ratio of the second and the third printing paper feeding roller pair. Therefore, the control means is not only compact in size, but can be readily set to the desired length of the printing paper to be cut by manually moving a pointer for cut length indication to a small extent to the corresponding scale marks.

Furthermore, in the cutting device of the invention which comprises the pair of first rollers, the pair of second rollers, cutter means having a stationary blade and a rotary blade, said rotary blade being disposed between the first and the second rollers, and a pair of third rollers, each element arranged along the path of the printing paper web from a paper roll is adapted to function in such a manner that the paper feeding speed of the first rollers is equal to or slightly lower than that of the second rollers for stretching the paper between the two roller pairs, and the feeding speed of the third rollers is adapted to be lower than the speed of the second rollers for the formation of a loop of printing paper between the third and second rollers. During cutting of the printing paper by the cutter means, only the first and second rollers are stopped without stopping transportation of the printing paper, and the printing paper is cut in its stretched state between the first and second rollers.

Accordingly, in the above described cutting device of the invention, since the printing paper is precisely cut into the desired length in the stretched state with neat cut end without requiring any separate rollers or the like for the formation of the loop, the size of the copying apparatus can be reduced in size to a large extent.

Furthermore, the neat cut end of the printing paper advantageously eliminates the possibility of the paper jamming.

Figure 2:
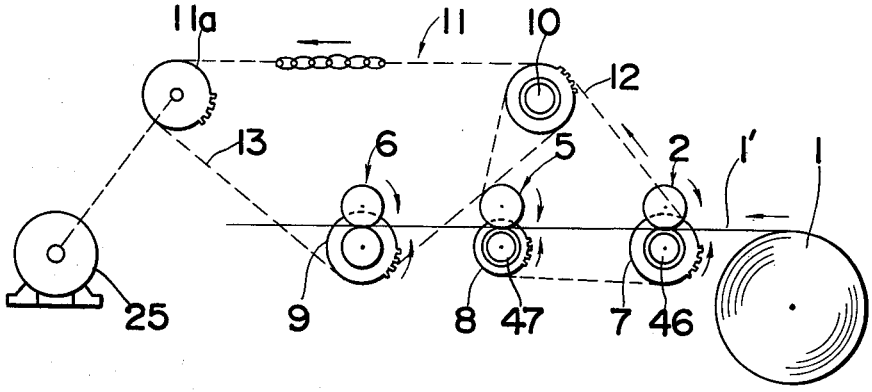
Figure 3:
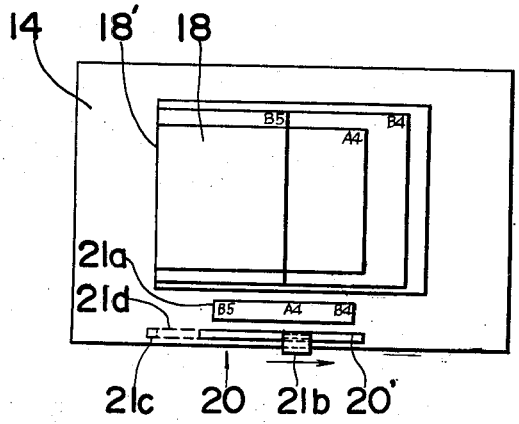
Figure 4:
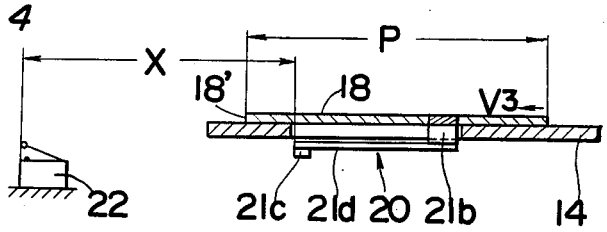
Figure 4:
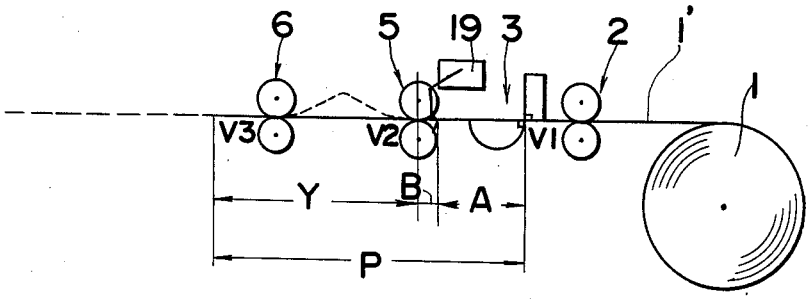
Figure 5:
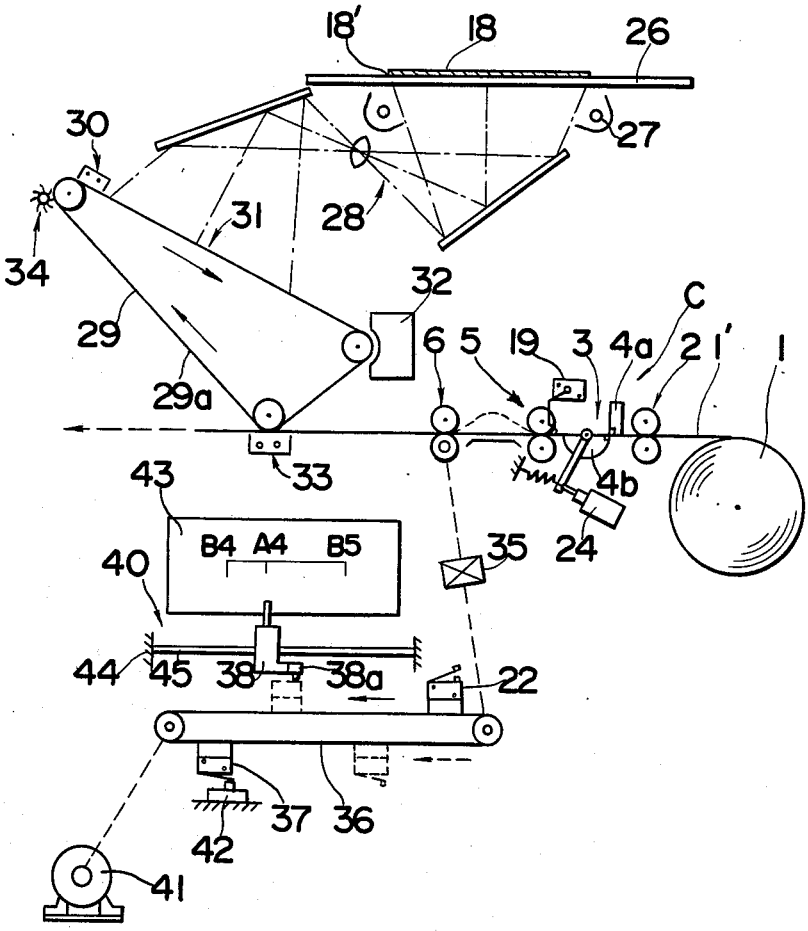

These and other objects and features of the present invention will become apparent from the following description taken in conjunction with the preferred embodiment thereof with reference to the attached drawings in which;

FIG. 1 is a schematic diagram showing a sectional view of a printing paper cutting device of the invention and mechanisms of a copying apparatus associated therewith, FIG. 2 is a schematic diagram particularly showing a driving system of the cutting device of FIG. 1, FIG. 3 is a top plan view of a control means for the cut length of the cutting device of the invention associated with a platform for an original to be copied of the copying apparatus, FIG. 4 is a schematic diagram explanatory of the relation between the size of the original and the graduation of a scale plate of the control means for the cutting device of the invention, and FIG. 5 is a schematic diagram showing a sectional side view of a printing paper cutting device according to a modification of the device of FIG. 1.

Before the description of the present invention proceeds, it is to be noted that like parts are designated by like numerals throughout the several views of in the accompanying drawings.

Referring to FIGS. 1 to 4, the printing paper cutting device C of the invention as applied to a slit exposure type electrophotographic copying apparatus comprises a pair of first rollers 2, cutter means 3 equipped with a stationary blade 4*a* and a rotatory blade 4*b*, a pair of second rollers 5, a pair of third rollers 6, and another pair of feeding rollers 6*a*, all of which are disposed sequentially along a path 1*a* for printing paper fed from a paper roll 1 rotatably supported adjacent to the first rollers 2.

A transparent platform 14 for placing an original 18 thereon which is driven by a driving means (not shown) is horizontally, reciprocally supported above the cutting device C at an upper portion of the copying apparatus. As the platform 14 moves in the scanning direction shown by an arrow s in FIG. 1, the original 18 is illuminated by a light source 15 provided below and adjacent to the platform 14, and the image rays of the original 18 are directed into a slit 17 through an optical system 16 fixedly provided between the platform 14 and the path 1a for the printing paper 1'.

The optical system 16 further compises a mirror ml fixedly disposed below the platform 14 at an angle of approximately 45° to the under surface of the platform 14 for directing the image rays from the original 18 to a fixed mirror lens *m*2 which in turn reflects the image rays to another fixed mirror *m*3 inclined at about 45° to the path of the printing paper 1' so as to direct, through the slit 17, the image rays onto the surface of the printing paper 1' which is cut into a required size by the cutter means 3 and charged by a corona charger 23 disposed between the rollers 6 and 6*a* to form an electrostatic latent image of the original 18 on the printing paper 1'.

When a microswitch 19 disposed between the rollers 5 and the cutter means 3 is actuated, the light source 15 is turned on, and the platform 14 advances in the scanning direction indicated by the arrow s.

Referring particularly to FIG. 2, the first rollers 2, the second rollers 5 and the third rollers 6 of the cutting device C are driven by a driving system 11.

A chain 13 is directed over a sprocket 9 fixed to one of the third rollers 6 and a sprocket 11a associated with a driving motor 25 through a clutch 10, while another chain 12 is directed, through the clutch 10, over a sprocket 7 secured to one of the first rollers 2 and a sprocket 8 also fixed to one of the second rollers 5. Accordingly, when the clutch 10 is engaged, the rollers 2, 5 and 6 are rotated by the driving force of the motor 25, but upon disengagement of the clutch 10, only the rollers 6 are adapted to be rotated by the motor 25.

By properly adjusting the number of teeth for the sprockets 7, 8 and 9, the third rollers 6 are adapted to rotate at a peripheral speed equal to the moving speed of the platform 14 (FIG. 1), but slower than the peripheral speed of the second rollers 5 to a certain extent. The peripheral speed of the first rollers 2 is adapted to be equal to or slightly slower than that of the second rollers 5.

Accordingly, when the web of printing paper 1' is fed as the pairs of rollers 2, 5 and 6 rotate, a loop or slackening of the web of paper 1' of formed between the rollers 5 and 6 due to the difference of peripheral speeds thereof. Moreover, the above pairs of rollers 2 and 5 are provided with one-way clutches 46 and 47 respectively for rotating the rollers 2 following the rotation of the rollers 5 as the web of paper 1' is drawn by the rollers 5 without excessively stretching the paper web 1' between the rollers 2 and 5, and for feeding the paper web 1' forward by the rotation of the third rollers 6 even when the rollers 2 and 5 are not rotating.

Referring particularly to FIGS. 3 and 4, the control means 20 for adjusting the length of the printing paper 1' to be cut from the roll 1 is disposed along one long edge of the rectangular transparent platform 14 on which the original 18 to be copied is placed with one side edge of the original 18 aligned with a datum line 18' marked on the platform 14. The control means comprises indication means having a scale plate 21*a* graduated with a contracted scale corresponding to the sizes of the original 18, for example, B5, A4 and B5 sizes and fixed on the upper surface of the platform 14 along one longitudinal side edge of the platform 14 in parallel to the scanning direction thereof; a slit 20' formed in the platform 14 parallel and adjacent to the scale plate 21*a*; a pointer 21*b* slidably received in the slit 20' for being manually set at the required scale mark on the plate 21*a* corresponding to the size of the original 18; a bar 21*d* of approximately the same length as the slit 20' fixed at one end thereof to the lower end of the pointer 21*b* and directed in the direction parallel to the slit 20'; and an actuating piece 21*c* for a microswitch 22 fixed at the other end of the bar 21*d*. The actuating piece 21*c* is adapted to contact a movable contact arm of the microswitch 22 for actuating a solenoid 24 (FIG. 1) which operates the rotatory blade 4*b* for the cutter means 3 as the platform 14 advances in the scanning direction *s*.

The relation between the size of the original 18 and the graduation of the scale plate 21*a* will be described hereinbelow with reference to FIG. 4.

Since the time required from the start of the platform 14 until the actuation of the microswitch 22 by the actuating piece 21*c* is equal to the sum of the time for the printing paper 1' to be sent from the microswitch 19 (FIG. 1) to the second rollers 5 and the time for the paper 1′ to be forwarded by the rollers 5, the following equations may be derived:

$$\frac{X}{V_3} = \frac{B}{V_1} + \frac{Y}{V_2} \text{ or } X = V_3\left(\frac{Y}{V_2} + \frac{B}{V_1}\right) \quad (1)$$

where $V_1$, $V_2$ and $V_3$ are printing paper feeding speeds of the rollers 2, 5 and 6 respectively, X is the moving distance of the platform 14 in the scanning direction during the time from the starting of the platform 14 to the actuation of the microswitch 22 by the actuating piece 21c after the actuation of the microswitch 19 by the leading edge of the printing paper web 1′ with the moving speed $V_3$ of the platform 14 being equal to the peripheral speed of the rollers 6, P is the size of the original 18, A is the distance between the cut position of the printing paper 1′ and the microswitch 19, B is the distance between the microswitch 19 and the rollers 5, and Y is the length of the printing paper 1′ to be forwarded by the rollers 5 (the loop or slackening of the printing paper 1′ between the rollers 5 and 6 is straightened to show the length of the paper 1′ in a straight line Y of FIG. 4).

On the other hand, since the web of the printing paper 1′ is cut into the same length as the original P by the cutter means 3 by the actuation of the microswitch 22, the following equation is established:

$$P = Y + A + B \text{ or } Y = P - (A + B) \quad 2$$

Hence, $$X = \frac{V_3}{V_2} P - \frac{V_3}{V_2}(A + B) + \frac{V_3}{V_1} B$$

wherein, since $$\frac{V_3}{V_2}(A + B) \text{ and } \frac{V_3}{V_1} B$$

are constants respectively, X will be a function of the size P of the original 18.

Accordingly, if, for example, B4 size of the JIS standard is to be graduated on the scale plate 21a (FIG. 3) with respect to A4 size, the scale mark for the B4 size may be graduated at a position $$\frac{V_3}{V_2}\{P(B4) - P(A4)\}$$

from the A4 scale mark. In other words, the distance between the B4 scale mark and the A4 scale mark can be equal to the distance obtained by multiplying the paper feeding speed of the rollers 5 and 6 by the difference of the lengths P of the original 18, and is given by contraction scale smaller than the actual lengthwise difference in sizes of the original 18.

It is needless to say that the platform 14 is adapted to return to the original starting position after advancing a predetermined distance to complete the exposure, for example, by the depression of another microswitch (not shown).

By this arrangement, the leading edge of the printing paper web 1′ from the roll 1 is manually inserted between the first rollers 2 with the original 18 placed on the predetermined position of the platform 14 and with the pointer 21b for cut size set to the contraction scale mark, for example, A4 on the scale plate 21a corresponding to the A4 size of the original 18.

Upon subsequent depression of a printing button (not shown), the pair of rollers 2, 5 and 6 driven by the driving system 11 in FIG. 2 rotate in the direction shown by arrows in FIG. 1. The rotation of the rollers 2 causes the paper web 1′ to be transported toward the left in FIG. 1 with the leading edge of the paper web 1′ contacting the movable arm of he microswitch 19 to actuate the microswitch 19, which generates a first signal for turning on the light source 15 and simultaneously advancing the platform 14 in the scanning direction s in FIG. 1. The web of printing paper 1′ is further transported by the rollers 5 and 6, and the printing paper 1′, is stretched between the rollers 2 and 5 as described above and forms the loop between the rollers 5 and 6 due to the difference of the paper feeding speeds. The paper web 1′ charged by the corona charger 23 subsequently reaches the slit 17. At the same time, the platform 14 with the original 18 placed thereon which is advancing in the scanning direction *s* starts forming the electrostatic latent image on the printing paper 1′ through the optical system 16. The platform 14 further advances toward the left in FIG. 1 with the actuating piece 21c contacting the movable arm of the microswitch 22 which generates a second signal. The second signal from the microswitch 22 actuates the clutch 10 (FIG. 2) for releasing the driving of the chain 12 which stops the rotation of the rollers 2 and 5 and simultaneously energizes the solenoid 24 (FIG. 1) for rotating the rotary blade 4b of the cutter means 3 counterclockwise in FIG. 1 thereby cuttinhg the printing paper web 1′ into a copy paper sheet.

Since the third rollers 6 continue to rotate during the above process and the second rollers 5 are equipped with the one-way clutch 47, the cut copy paper sheet 1′ is transported to the exposure position below the slit 17 through the rollers 6 and the rollers 6a and subsequently discharged out of the copying apparatus after completion of developing and fixing of the image by conventional means.

The platform 14 is adapted to return to the original starting position by known means after having advanced a predetermined distance, thus completing one copying cycle.

Referring to FIG. 5, there is shown a modification of the printing paper cutting device of the invention as applied to a transfer type dry process electrophotographic copying apparatus of total surface exposure system.

The above described copying apparatus mainly comprises a stationary transparent platform 26 with a datum line thereon with which one side edge of the original 18 is to be aligned, a pair of lamps 27 provided below and adjacent to the platform 26 for illuminating the total surface of the original 18, and an optical system 28 fixedly provided below the platform 26 including a pair of reflecting mirrors suitably inclined in spaced relation to each other with a lens disposed therebetween so as to direct the light image of the original 18 onto the exposure surface 31 on the forward run of a photosensitive photoreceptor 29 in the configuration of an endless belt movably suspended by three rollers below the optical system 28 and driven by a driving means (not shown) in the direction of an arrow in FIG. 5. The photoreceptor surface 29a of the photoreceptor 29 is uniformly charged in advance by a corona charger 30 for the formation of an electrostatic latent image thereon at the exposure position 31 by the image rays from the optical system 28. This latent image is developed into a visible toner powder image at a developing device 32 disposed along the path of the photoreceptor 29.

The toner powder image thus formed is subsequently transferred at the transfer device 33 onto a copy paper sheet cut by the cutter means 3 and transported thereto by the third rollers 6. The toner powder remaining on the photoreceptor surface 29*a* is removed therefrom at a cleaning device 34.

Control means 40 associated with the cutting device C of the invention for adjusting the length of the printing paper 1' fed from the roll 1 comprises the datum line 18' marked on the platform 14 for aligning one side edge of the original 18 therewith and indication means having a scale plate 43 graduated with a contracted scale corresponding to the sizes of the original 18 as in the embodiment of FIG. 1 and fixed at a suitable place on the side wall of the copying apparatus housing, and a pointer 38 slidably mounted on a bar 45 secured to the frame 44 of the copying apparatus at a position parallel to and adjacent the scale plate 43 so that the pointer 38 can be manually set to the scale mark of the contraction scale plate 43 corresponding to the size of the original 18. An actuating piece 38a is fixedly attached to one end of the pointer 38 for contacting the movable arm of a microswitch 22 fixed on an endless belt 36 mentioned below.

The endless belt 36 on which the microswitch 22 and a microswitch 37 are fixed at a predetermined interval is movably supported on a pair of rollers and is associated with the rollers 6 of the cutting device C through an electromagnetic clutch 35, which clutch 35 is electrically connected to a reversible motor 41 through a switch (not shown) for alternately rotating the belt 36 in the forward or reverse direction.

Accordingly, when the electromagnetic clutch 35 is energized by the first signal from the microswitch 19 as a first detecting means upon contact of the leading edge of the printing paper 1' transported by the first rollers 2 with the movable arm of the microswitch 19, the rotation of the third rollers 6 is transmitted to the belt 36 through the reversible motor 41; the belt 36 then moves in the direction shown by the real line arrow in FIG. 5 at a speed $V_3$. As the belt 36 moves, the movable contact arm of the microswitch 22 fixed on the belt 36 contacts the actuating piece 38*a* of the pointer 38, causing the microswitch 22 to generate a second signal which energizes the solenoid 24 to rotate the rotatory blade 4*b* counterclockwise in FIG. 5 for cutting the web of the printing paper 1' into a copy paper sheet. Simultaneously, the second signal from the microswitch 22 de-energizes the electromagnetic clutch 35 and causes the motor 41 to rotate in the reverse direction. The reverse rotation of the motor 41 moves the belt 36 toward the original starting position in the direction shown by the dotted line arrow in FIG. 5 and the reversible motor 41 is stopped by a returning confirmation signal generated by the microswitch 37 upon contact of the movable arm of the switch 37 with an actuating piece 42 fixed on the frame of the apparatus, in which case the microswitch 22 has returned to the original starting position.

It should be noted here that the printing paper cutting device of the invention can be applied to various other types of electrophotographic copying apparatuses. For example, the copying apparatus in FIG. 1 with the reciprocating platform and fixed optical system may be one with a fixed platform and movable optical system, or one of the transfer type employing slit exposure with a photoreceptor of the drum type.

Furthermore, the control means for adjusting the length of printing paper including the scale plate and the microswitch 22 as the second detecting means may be mounted at any suitable places on the copying apparatus and moving members thereof so long as the control means is actuatably associated with the microswitch 22.

As is clear from the above description, according to the printing paper cutting device of the invention, since the printing paper is cut into the same size as the original to be copied by simply setting the pointer of the control means manually to the scale mark of the scale plate corresponding to the size of the original with the scale plate graduated with scale marks contracted by the paper feeding speed ratio of the second and the third roller pairs, a compact size scale plate occupying small space is sufficient for the purpose, and the printing paper is cut into different sizes by much less moving distance of the pointer along the corresponding scale marks than the actual lengths to be cut. This arrangement results in easy operation of the copying apparatus and is particularly advantageous when various sizes of copy paper are required in continuous copying.

Furthermore, in the printing paper cutting device of the invention, the paper feeding speed of the first rollers is adapted to be equal to or slightly lower than that of the second rollers for stretching the printing paper between the first and second rollers with the paper feeding speed of the third rollers adjusted to be slower than that of the above second rollers for forming the loop of printing paper between the third and second rollers. Consequently, in subsequent cutting of the copy paper sheet, only the first and second rollers are stopped without suspending transportation of the printing paper so as to cut the printing paper by the cutter means provided between the first and second rollers. By this arrangement, no large sized members as in the conventional devices are required for the formation of the loop, and the size of the cutting device can be reduced by the amount of the loop to be formed.

Moreover, since the printing paper is cut in its stationary and stretched state without forming the loop in the vicinity of the cutter means, such defects as slantwise cutting, unevenly cut edges or damage by the rotary blade are not caused, and consequently neat and clean copied sheets are obtained. The printing paper to be fed by the third rollers into various processing devices such as the exposure device etc., after having been cut into the required size is free from jamming, because no slackening takes place in the vicinity of the cutter means.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A copy paper cutting device for use in an electrophotographic copying apparatus which uses roll-type copy paper on which the image of the object to be reproduced is printed, said device comprising:

transparent platform means for supporting the object to be copied;

optical projecting means beneath said transparent platform means for projecting the image of the object to be copied on said transparent platform means to an exposure position;

roller means positioned adjacent the copy paper fed from the roll of copy paper, on both sides of the copy paper along the path of the copy paper as it passes through the device, said roller means comprised of:

a first pair of rotating rollers positioned on both sides of the copy paper as it is fed from said roll of copy paper;

a second pair of rotating rollers adjacent and spaced from said first pair of rollers on both sides of said copy paper, said second pair of rollers rotating at a speed at least as fast as said first pair of rollers, whereby the copy paper is stretched between said first and second pairs of rollers; and a third pair of rotating rollers adjacent and spaced from said second pair of rollers on both sides of said copy paper, said third pair of rollers rotating at a speed slower than said second pair of rollers, whereby a predetermined amount of loop of copy paper is formed between said second and third pairs of rollers;

cutting means located between said first and second pairs of rollers for cutting said copy paper to the size of said object to be copied;

first switch means between said cutting means and said second pair of rollers for actuating said optical projecting means in response to said copy paper passing between said cutting means and said second pair of rollers;

rotating means operatively connected to said roller means for rotating said roller means;

second switch means operatively connected to said cutting means and to said first and second pairs of rollers for deactuating said first and second pairs of rollers and for actuating said cutting means; and control means adjacent said second switch means for contact therewith and for controlling the size of copy paper cut from said copy paper roll in relation to the size of the object being copied, said control means comprised of:

a scale member graduated with a contracted scale marked with a plurality of scale marks corresponding to the sizes of the objects to be copied on said transparent platform means;

a pointer bar fitted in a slot adjacent said scale member, said pointer bar movably slidable to the desired scale mark on said scale member corresponding to the size of the object to be copied, and a first actuating member attached to said pointer bar and movable therewith for contacting said second switch means.

2. A copy paper cutting device as claimed in claim 1, wherein a first mark on said graduated scale member representing the length of one size of object to be copied, is spaced from a second mark indicating the size of a different object to be copied by a distance corresponding to the product of the ratio of the feeding speed of said third pair of rollers to said second pair of rollers and the difference of the length of the objects indicated by said first mark and said second mark.

3. A copy paper cutting device for use in an electrophotographic copying apparatus which uses roll-type copy paper on which the image of the object to be reproduced is printed, said device comprising:

transparent platform means for supporting the object to be copied;

optical projecting means beneath said transparent platform means for projecting the image of the object to be copied on said transparent platform means to an exposure position;

roller means positioned adjacent the copy paper fed from the roll of copy paper, on both sides of the copy paper along the path of the copy paper as it passes through the device, said roller means comprised of:

a first pair of rotating rollers positioned on both sides of the copy paper as it is fed from said roll of copy paper, a second pair of rotating rollers adjacent and spaced from said first pair of rollers on both sides of said copy paper, said second pair of rollers rotating at a speed at least as fast as said first pair of rollers, whereby the copy paper is stretched between said first and second pairs of rollers; and a third pair of rotating rollers adjacent and spaced from said second pair of rollers on both sides of said copy paper, said third pair of rollers rotating at a speed slower than said second pair of rollers, whereby a predetermined amount of loop of copy paper is formed between said second and third pairs of rollers;

cutting means located between said first and second pairs of rollers for cutting said copy paper;

rotating means operatively connected to said roller means for rotating said roller means, first switch means operatively connected to said cutting means and to said first and second pairs of rollers for deactuating said first and second pairs of rollers and for actuating said cutting means; and control means adjacent said first switch means for contacting said first switch means and for controlling the size of copy paper cut from said copy paper roll, said control means comprised of:

a scale member graduated with a contracted scale marked with a plurality of scale marks corresponding to sizes of paper to be cut from said roll of copy paper, a first mark on said graduated scale member, representing the length of one size of object to be copied, spaced from a second mark indicating the size of a different object to be copied by a distance corresponding to the product of the ratio of the feeding speed of said third pair of rollers to said second pair of rollers and the difference of the length of the objects indicated by said first mark and said second mark, movable means adjacent said scale member for movably sliding to the desired scale mark on said scale member corresponding to the size of the paper to be cut, and first actuating means attached to said movable means and movable therewith for contacting said first switch means.

4. A copy paper cutting device for use in an electrophotographic copying apparatus which uses roll-type copy paper on which the image of the object to be reproduced is printed, said device comprising:

transparent platform means for supporting the object to be copied;

optical projecting means beneath said transparent platform means for projecting the image of the object to be copied on said transparent platform means to an exposure position;

roller means positioned adjacent the copy paper fed from the roll of copy paper, on both sides of the copy paper along the path of the copy paper as it passes through the device, said roller means comprised of:

a first pair of rotating rollers positioned on both sides of the copy paper as it is fed from said roll of copy paper, a second pair of rotating rollers adjacent and spaced from said first pair of rollers on both sides of said copy paper, said second pair of rollers rotating at a speed at least as fast as said first pair of rollers, whereby the copy paper is stretched between said first and second pairs of rollers, and a third pair of rotating rollers adjacent and spaced from said second pair of rollers on both sides of said copy paper, said third pair of rollers rotating at a speed slower than said second pair of rollers, whereby a predetermined amount of loop of copy paper is formed between said second and third pairs of rollers;

cutting means located between said first and second pairs of rollers for cutting said copy paper;

rotating means operatively connected to said roller means for rotating said roller means;

first switch means between said cutting means and said second pair of rollers for actuating said optical projecting means in response to said copy paper passing between said cutting means and said second pair of rollers;

second switch means operatively connected to said cutting means and to said first and second pairs of rollers for deactuating said first and second pairs of rollers and for actuating said cutting means; and control means adjacent said second switch means for contacting said second switch means and for controlling the size of copy paper cut from said copy paper roll, said control means comprised of:

a scale member graduated with a contracted scale marked with a plurality of scale marks corresponding to the sizes of paper to be cut from said roll of copy paper, movable means adjacent said scale member for movably sliding to the desired scale mark on said scale member corresponding to the size of the paper to be cut, and first actuating means attached to said movable means and movable therewith for contacting said second switch means.

5. A copy paper cutting device as claimed in claim 4, wherein:

said transparent platform means is movable horizontally above said optical projecting means in response to actuation of said optical projecting means by said first switch means, and said scale member and said movable means with said first actuating means attached thereto are fitted onto and through said transparent platform means and are movable therewith, whereby after sliding said movable means to the proper position on said scale member corresponding to the size of the copy paper to be cut, said first switch means actuates said optical projecting means and causes said transparent platform means to move horizontally, thereby causing said first actuating means moving with said transparent platform means to contact said second switch means, thus deactuating said first and second pairs of rollers and actuating said cutting means.

6. A copy paper cutting device as claimed in claim 4, wherein:

said transparent platform means is stationarily fixed above said optical projecting means;

said scale member and said movable means with said first actuating means attached thereto are fitted to said copying apparatus adjacent said transparent platform means; and said second switch means is comprised of:

a movable endless belt positioned adjacent said movable means with said first actuating means attached thereto, a second actuating means adjacent said endless belt, a first belt switch on said endless belt positioned to contact said first actuating means as said endless belt moves, a second belt switch on said endless belt spaced from said first belt switch and positioned to contact said second actuating means when said first belt switch is not contacting said first actuating means, motor means operatively connected to said movable endless belt for moving said endless belt in response to signals generated by said first switch means and said first and second belt switches, and an electromagnetic clutch electrically connecting said third pair of rollers and said motor means to said first and second belt switches, said clutch also being actuated by the signal generated by said first switch means, whereby actuating said first switch means causes said clutch to activate, said motor means to rotate said endless belt, and said first belt switch on the endless belt to contact said first actuating means on said movable means, thereby generating a signal from said first belt switch to said cutting means and said first and second pairs of rollers and simultaneously signalling said clutch to actuate said motor means, thus again rotating said endless belt, disengaging said first belt switch from said first actuating means, and causing said second belt switch to engage said second actuating means, thereby generating a signal to said clutch directing said motor means to stop.

* * * * *